US009531141B2

(12) United States Patent
Wang et al.

(10) Patent No.: US 9,531,141 B2
(45) Date of Patent: Dec. 27, 2016

(54) ELECTRICAL RECEPTACLE CONNECTOR

(71) Applicant: ADVANCED-CONNECTEK INC., New Taipei (TW)

(72) Inventors: Yao-Te Wang, New Taipei (TW); Ya-Ling Chen, New Taipei (TW); Ruei-Si Hong, New Taipei (TW)

(73) Assignee: ADVANCED-CONNECTEK INC., New Taipei (TW)

( * ) Notice: Subject to any disclaimer, the term of this patent is extended or adjusted under 35 U.S.C. 154(b) by 0 days.

(21) Appl. No.: 14/962,885

(22) Filed: Dec. 8, 2015

(65) Prior Publication Data

US 2016/0172802 A1 Jun. 16, 2016

(30) Foreign Application Priority Data

Dec. 12, 2014 (TW) ..... 103143583 A

(51) Int. Cl.

| | |
|---|---|
| ***H01R 13/648*** | (2006.01) |
| ***H01R 24/60*** | (2011.01) |
| ***H01R 13/6471*** | (2011.01) |
| *H01R 107/00* | (2006.01) |

(52) U.S. Cl.

CPC ..... *H01R 24/60* (2013.01); *H01R 13/6471* (2013.01); *H01R 2107/00* (2013.01)

(58) Field of Classification Search

CPC ..... H01R 13/65802; H01R 23/7073
USPC ..... 439/607.01, 607.11, 607.13, 660
See application file for complete search history.

(56) References Cited

U.S. PATENT DOCUMENTS 7,878,847 B2 * 2/2011 He ..... H01R 27/00 439/541.5
2010/0248552 A1 * 9/2010 He ..... H01R 27/02 439/638

FOREIGN PATENT DOCUMENTS

TW M468813 12/2013

* cited by examiner

*Primary Examiner* — Phuongchi T Nguyen
(74) *Attorney, Agent, or Firm* — Muncy, Geissler, Olds & Lowe, P.C.

(57) ABSTRACT

An electrical receptacle connector includes an insulated housing, flexible terminals, and flat terminals. The insulated housing includes a base portion and a tongue portion. The flexible terminals and the flat terminals are held in the base portion and disposed at an upper surface of the tongue portion. The flat terminals are arranged in front of the flexible terminals and include two pairs of signal terminals and a ground terminal between the signal terminals. Each flat terminal includes a flat contact portion, a tail portion, and a body portion between the flat contact portion and the tail portion. The body portion of the ground terminal includes two first widening portions extended outward from two sides thereof. A first distance is defined between each first widening portion and the body portion of the corresponding nearest signal terminal. A second distance is defined between the two signal terminals for each pair thereof.

10 Claims, 10 Drawing Sheets

100

ELECTRICAL RECEPTACLE CONNECTOR

CROSS-REFERENCES TO RELATED APPLICATIONS

This non-provisional application claims priority under 35 U.S.C. §119(a) on Patent Application No. 103143583 filed in Taiwan, R.O.C. on 2014 Dec. 12, the entire contents of which are hereby incorporated by reference.

FIELD OF THE INVENTION

The instant disclosure relates to an electrical connector, and more particular to an electrical receptacle connector.

BACKGROUND

Generally, Universal Serial Bus (USB) is a serial bus standard to the PC architecture with a focus on computer interface, consumer and productivity applications. The existing Universal Serial Bus (USB) interconnects have the attributes of plug-and-play and ease of use by end users. Now, as technology innovation marches forward, new kinds of devices, media formats and large inexpensive storage are converging. They require significantly more bus bandwidth to maintain the interactive experience that users have come to expect. In addition, the demand of a higher performance between the PC and the sophisticated peripheral is increasing. The transmission rate of USB 2.0 is insufficient. As a consequence, faster serial bus interfaces such as USB 3.0, are developed, which may provide a higher transmission rate so as to satisfy the need of a variety devices.

Nowadays, electronic devices generate more electromagnetic waves as becoming more multifunctional. However, the more electromagnetic waves the devices generate, the worse radiofrequency interference (RFI) affects the operation or the signal transmission between devices.

For a conventional USB electrical connector assembly having a conventional USB electrical plug connector mating with a conventional electrical receptacle connector, signal interferences would be generated during signal transmission. Therefore, the signal transmission accuracy may be deficient. For example, the signal transmission of a USB 3.0 connector on a laptop affects the operation of a wireless mouse with 2.4 GHz transmission speed connected to the same laptop. Under this situation, the reaction of the mouse lags behind the user's operation.

SUMMARY OF THE INVENTION

It is therefore necessary to establish and develop a new architecture of USB connectors to address the previously mentioned needs of platforms and devices, while retaining all of the functional benefits of USB that form the basis for this most popular of computing device interconnects.

In view of this, the instant disclosure provides an electrical receptacle connector. An exemplary embodiment of the electrical receptacle connector comprises a metallic shell, an insulated housing, a plurality of flexible terminals, and a plurality of flat terminals. The metallic shell defines a receiving cavity therein. The insulated housing is received in the receiving cavity. The insulated housing comprises a base portion and a tongue portion extended from one of two sides of the base portion. The tongue portion has an upper surface and a lower surface, and the upper surface is opposite to the lower surface. The flexible terminals are held in the base portion and the tongue portion and disposed at the upper surface of the tongue portion. The flat terminals are held in the base portion and the tongue portion and disposed at the upper surface of the tongue portion. The flat terminals are arranged in front of the flexible terminals. The flat terminals comprise two pairs of signal terminals and a ground terminal between the two pairs of signal terminals. Each of the flat terminals comprises a flat contact portion arranged at the tongue portion, a tail portion extended from the rear end of the flat contact portion, and a body portion between the flat contact portion and the tail portion. The body portion of the ground terminal comprises two first widening portions respectively extended outwardly from two sides thereof. A first distance is defined between each of the first widening portions and the body portion of the corresponding nearest signal terminal. A second distance is defined between the two signal terminals for each pair of the signal terminals. A third distance is the distance between the body portions of two pair of the signal terminals.

Accordingly, the third distance is widened because of the widening portion of the body portion of the ground terminal, therefore the crosstalk interferences and radiofrequency interference (RFI) between the body portions of the two pairs of the signal terminals are reduced. Next, the first distance may be less than, equal to, or greater than the second distance to improve the signal transmission stability, the coupling effect between the signal terminals, to reduce unnecessary energy emissions, and to reduce the crosstalk interferences between the first pair of signal terminals (USB 3.0/USB 3.1) and the second pair of signal terminals (USB 3.0/USB 3.1) during signal transmission. In addition, the second distance may be adjusted to be much smaller, so that the signal coupling between each pair of signal terminals can be further enhanced. Moreover, the distance between the signal terminals of the flat terminals and the signal terminals of the flexible terminals can be increased, such that the crosstalk interference between the signal terminals of the flexible terminals (USB 2.0) and the signal terminals of the flat terminals (USB 3.0/USB 3.1) can be improved.

Detailed description of the characteristics, and the advantages of the instant disclosure, are shown in the following embodiments. The technical content and the implementation of the instant disclosure should be readily apparent to any person skilled in the art from the detailed description, and the purposes and the advantages of the instant disclosure should be readily understood by any person skilled in the art with reference to content, claims and drawings in the instant disclosure.

BRIEF DESCRIPTION OF THE DRAWINGS

The instant disclosure will become more fully understood from the detailed description given herein below for illustration only, and thus not limitative of the instant disclosure, wherein.

DETAILED DESCRIPTION

Figure 1:
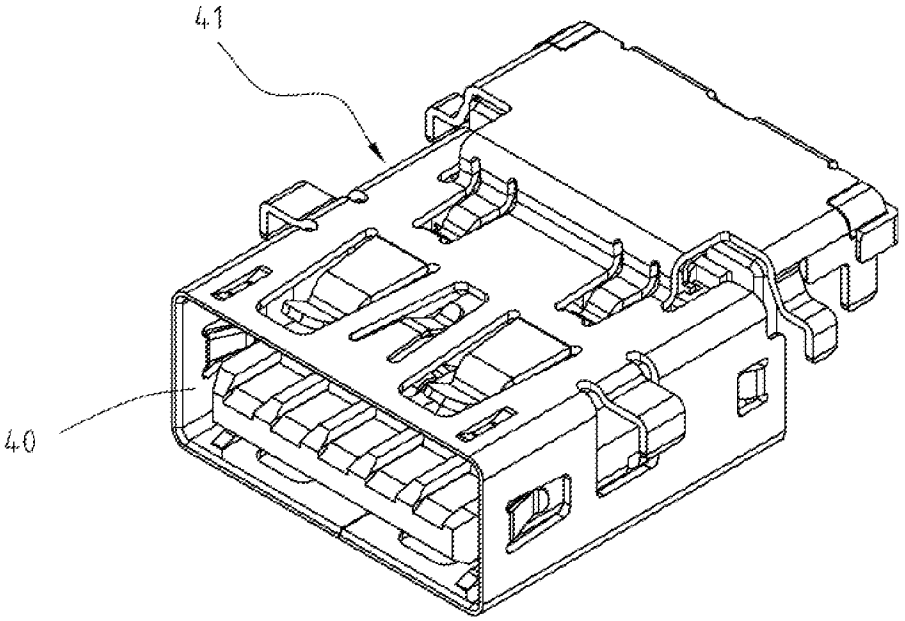
FIG. 1 is a perspective view of an electrical receptacle connector according to the instant disclosure.

Please refer to FIG. 1 to FIG. 6, illustrating an exemplary embodiment of an electrical receptacle connector 100 according to the instant disclosure. The electrical receptacle connector 100 described herein is a USB 3.1 electrical connector or a USB 3.0 electrical connector met the specification announced by USB-IF organization. The electrical receptacle connector 100 comprises an insulated housing 11, a plurality of flexible terminals 21, a plurality of flat terminals 22, and a metallic shell 41. The metallic shell 41 is a hollowed shell and defines a receiving cavity 40 therein. The insulated housing 11 is received in the receiving cavity 40 and the metallic shell 41 surrounds four sides of the insulated housing 11.

Figure 2:
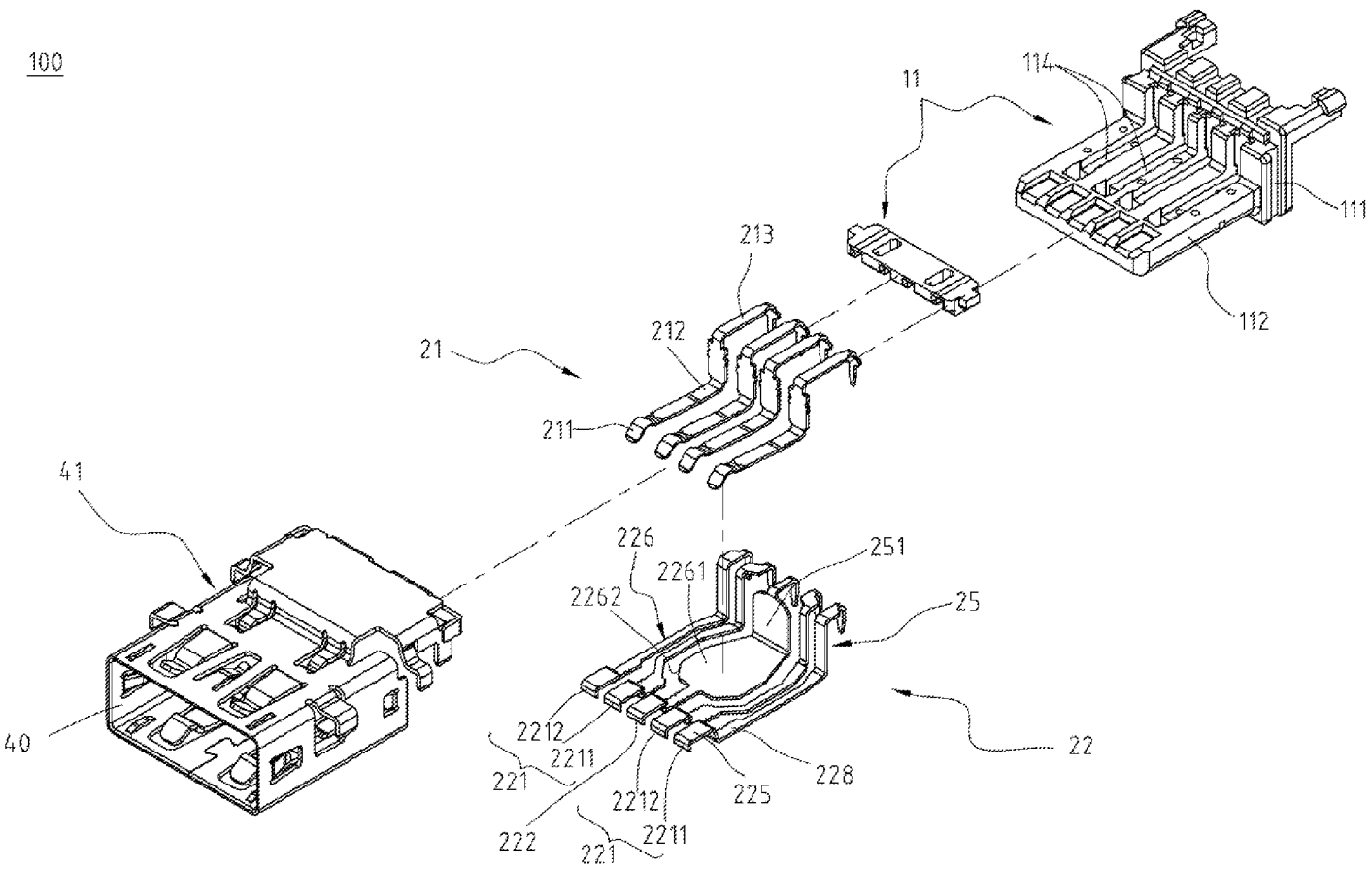
FIG. 2 is an exploded view of the electrical receptacle connector according to the instant disclosure.

Please refer to FIG. 2. The insulated housing 11 comprises a base portion 111 and a tongue portion 112. Here, the base portion 111 and the tongue portion 112 are manufactured by proper injection molding techniques, and the tongue portion 112 is extended from one of two sides of the base portion 111. The tongue portion 112 has an upper surface and a lower surface opposite to the upper surface. The insulated housing 11 further comprises a plurality of positioning slots 114 each defined longitudinally on the upper surface of the tongue portion 112 and extended to the base portion 111.

Figure 3:
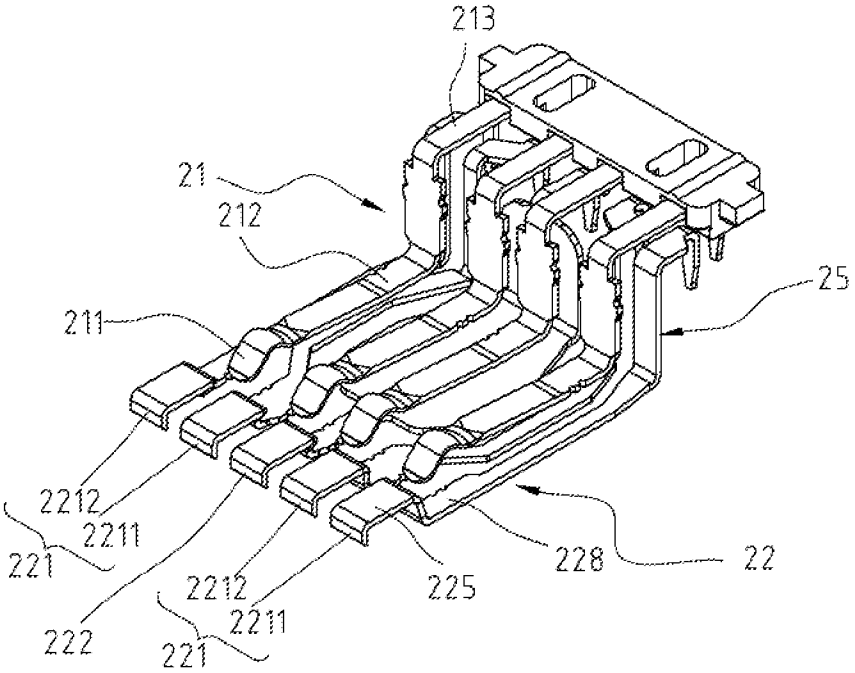
FIG. 3 is perspective view showing flexible terminals and flat terminals of the electrical receptacle connector according to the instant disclosure.
Figure 4:
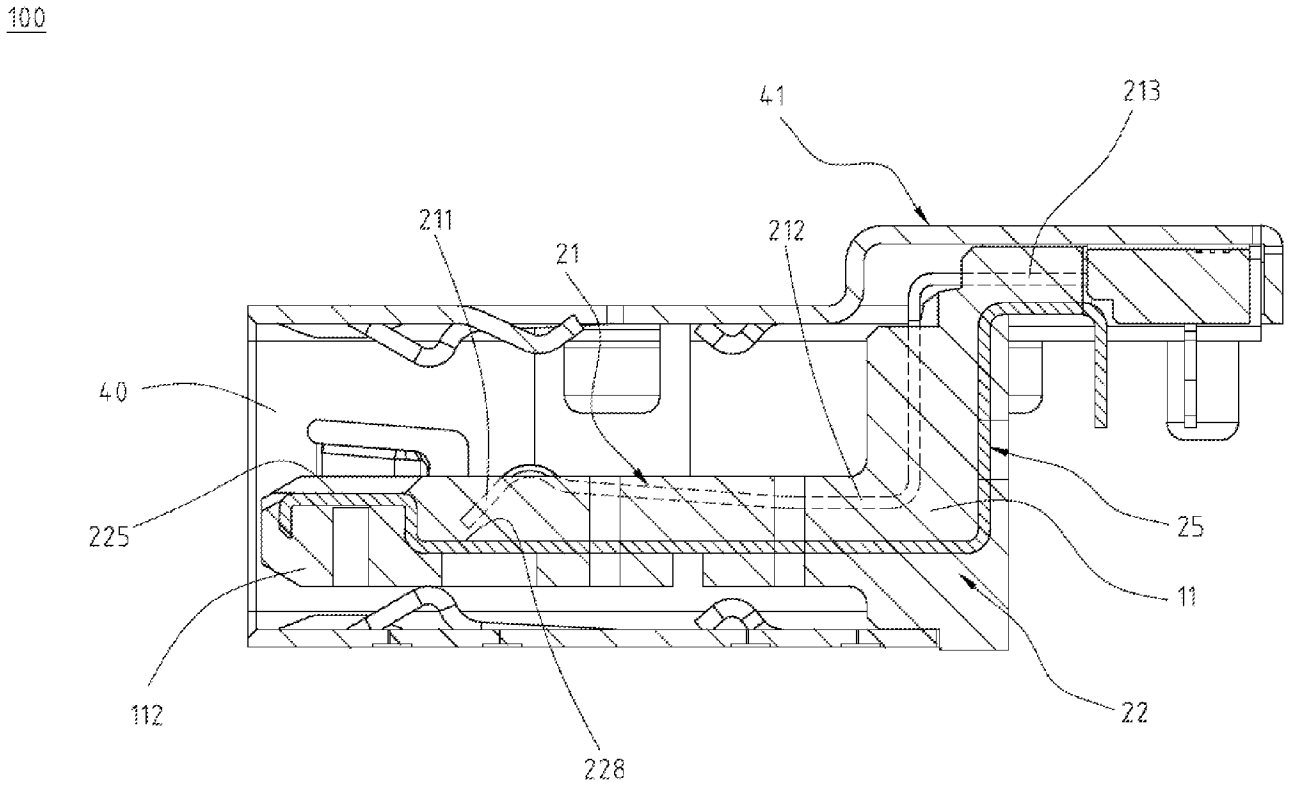
FIG. 4 is a lateral sectional view of the electrical receptacle connector according to the instant disclosure.
Figure 5:
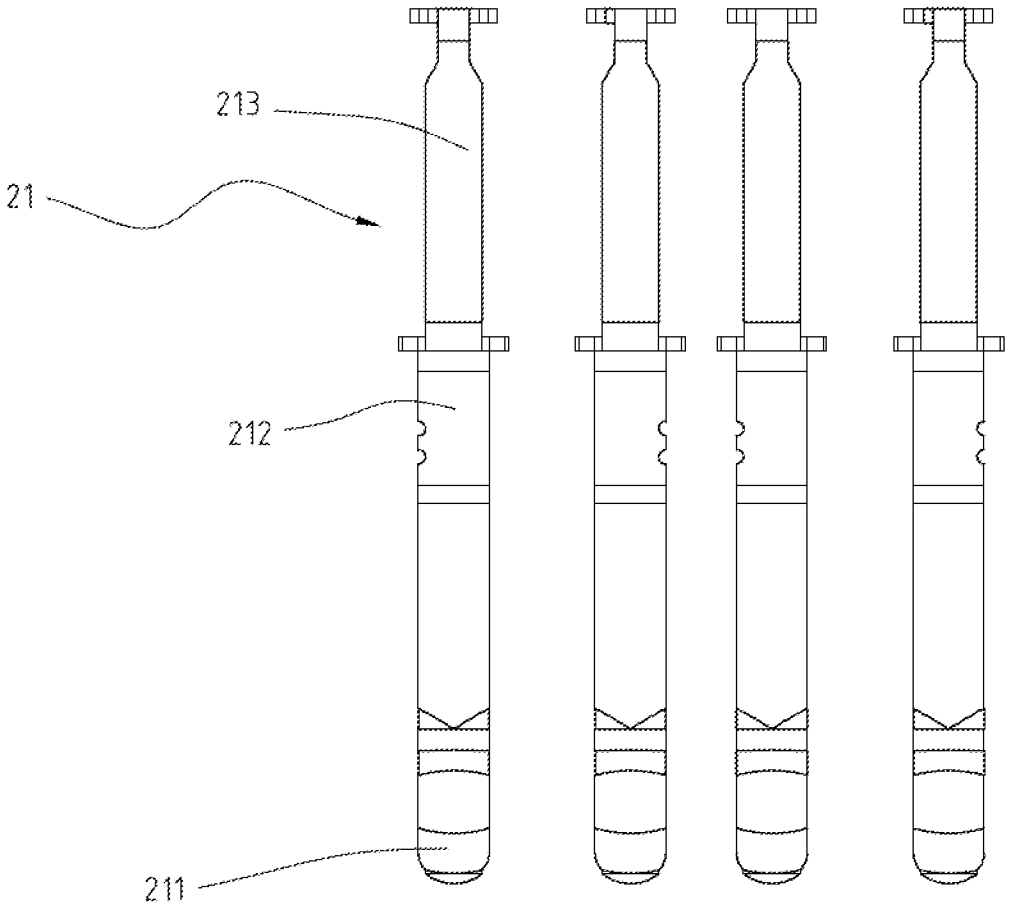
FIG. 5 is a top view of the flexible terminals of the electrical receptacle connector according to the instant disclosure.

Please refer to FIG. 3, and FIG. 5. The flexible terminals 21 are conformed to the specification of a USB 2.0 connection interface and arranged as one row. The number of the flexible terminals 21 may be four. The flexible terminals 21 are received in the respective positioning slots 14. Each of the flexible terminals 21 is held in the base portion 111 and the tongue portion 112 and is disposed at the upper surface of the tongue portion 112. Each of the flexible terminals 21 comprises a flexible contact portion 211 arranged at the upper surface of the tongue portion 112 for being in contact with plug terminals of an electrical plug connector, a tail portion 213 extended from the rear end of the flexible contact portion 211 and soldered to a circuit board, and a body portion 212 between the flexible contact portion 211 and the tail portion 213. The flexible contact portion 211, the body portion 212, and the tail portion 213 of each of the flexible terminals 21 are, but not limited to, different parts of a single flexible terminal 21. Here, the flexible terminals 21 are fixed to the positioning slots 14 of the insulated housing 11 by assembling means. The tail portions 213 of the flexible terminals 21 are placed on the base portion 111 from the front (positioning slots 114) to the rear of the base portion 111.

Figure 6:
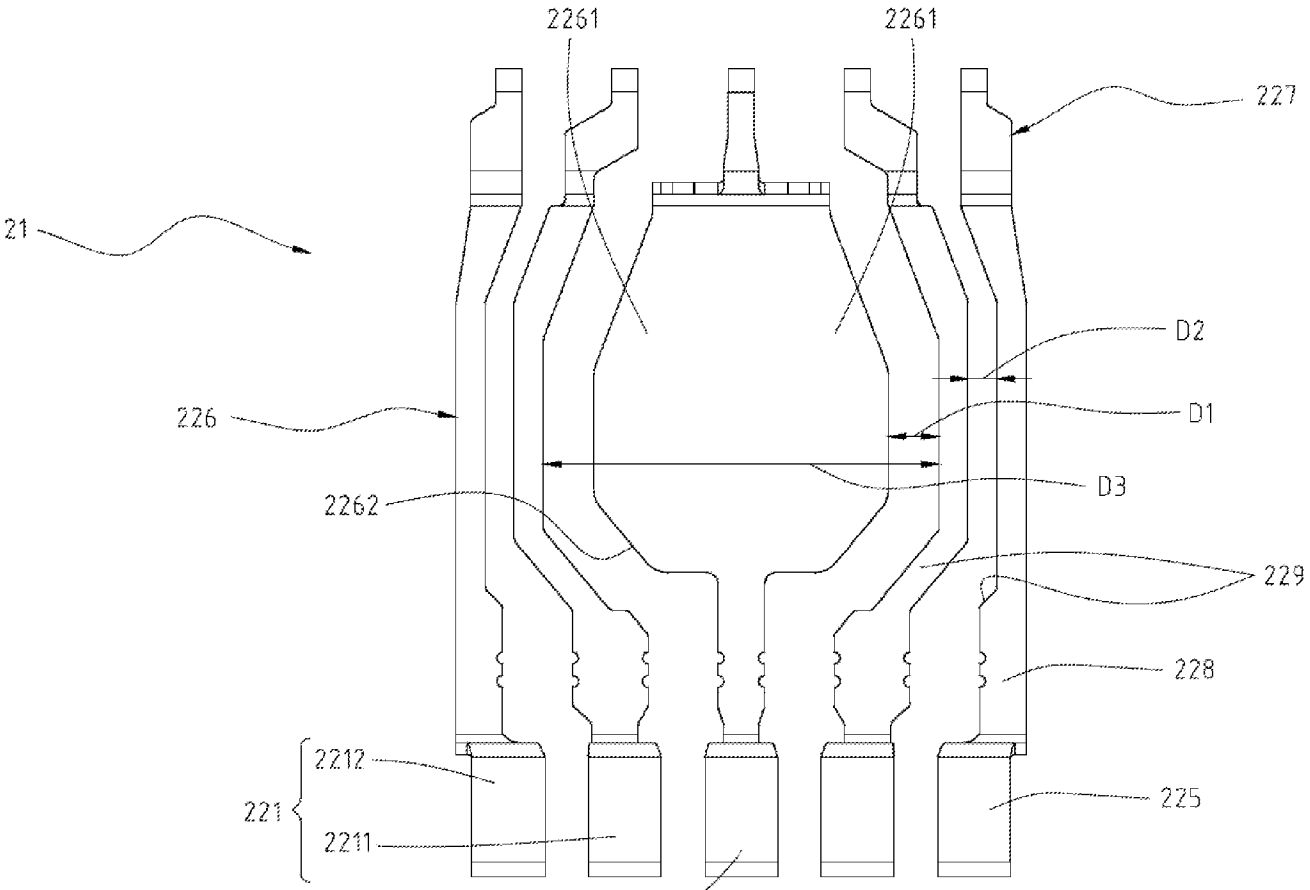
FIG. 6 is a top view of the flat terminals of the electrical receptacle connector.

Please refer to FIG. 2, FIG. 3, and FIG. 6. The flat terminals 22 are arranged as one row. The number of the flat terminals 22 may be five. Each of the flat terminals 22 is held in the base portion 111 and the tongue portion 112 and is disposed at the upper surface of the tongue portion 112. As shown in FIG. 2 and FIG. 3, the flat terminals 22 are arranged in front of the flexible terminals 21. Here, the flat terminals 22 are assembled to the insulated housing 11 when proper insert-molding techniques are applied for forming the base portion 111 and the tongue portion 112. The flexible terminals 21 and the flat terminals 22 are conformed to the specification of a USB 3.0 or USB 3.1 connection interface standardized by USB-IF organization.

Please refer to FIG. 2, FIG. 3, and FIG. 6. The flat terminals 22 comprise two pairs of signal terminals 221 and a ground terminal 222 between the two pairs of signal terminals 221. A first distance D1 is defined between the ground terminal 222 and each of the nearest signal terminals 221. Each of the flat terminals 22 comprises a flat contact portion 225 arranged at the upper surface of the tongue portion 112 for being in contact with plug terminals of an electrical connector, a tail portion 227 extended from the rear end of the flat contact portion 225 and soldered to the circuit board, and a body portion 226 between the flat contact portion 225 and the tail portion 227. The flat contact portion 225, the body portion 226, and the tail portion 227 of each of the flat terminals 22 are, but not limited to, different parts of a single flat terminal 22.

Please refer to FIG. 2, FIG. 3, and FIG. 6. Each pair of signal terminals 221 comprises a positive signal terminal 2211 and a negative signal terminal 2212. Specifically, the first pair of signal terminals 221 comprises a first positive signal transmitting terminal and a first negative signal transmitting terminal (transmitter differential terminals), and the second pair of signal terminals 221 comprises a second positive signal receiving terminal and a second negative signal receiving terminal (receiver differential terminals). The positive signal terminal 2211 of the first pair of signal terminals 221 is between the negative signal terminal 2212 of the first pair of signal terminals 221 and the ground terminal 222. The negative signal terminal 2212 of the second pair of signal terminals 221 is between the positive signal terminal 2211 of the second pair of the signal terminals 221 and the ground terminal 222. That is, the positive signal terminal 2211 of the first pair of signal terminals 221 and the negative signal terminal 2212 of the second pair of signal terminals 221 are respectively arranged nearby two sides of the ground terminal 222.

Please refer to FIG. 2, FIG. 3, and FIG. 6. For each of the signal terminals 221, a slant portion 229 is extended between the flat contact portion 225 and the body portion 226. That is, the slant portion 229 is between the body portion 226 and the two first widening portions 2261. Accordingly, for each of the signal terminals 221, the positional relationship between the flat contact portion 225 and the body portion 226 may be adjusted by the slant portion 229 to allow the flat contact portion 225 and the body portion 226 to be arranged at different horizontal lines. That is, the flat contact portion 225 and the body portion 226 of the positive signal terminal 2211 of the first pair of signal terminals 221 are arranged at different horizontal lines, and the flat contact portion 225 and the body portion 226 of the negative signal terminal 2211 of the second pair of signal terminals 221 are arranged at different horizontal lines. In the other words, the body portion 226 of each of the signal terminals 221 is protruding away from a corresponding lateral side of the first widening portion 2261.

Please refer to FIG. 2, FIG. 3, and FIG. 6. In this embodiment, the body portion 226 of the ground terminal 222 comprises two first widening portions 2261 respectively extended outward from two sides thereof. That is, the body portion 226 of the ground terminal 222 is formed as a rectangular plate, and the two first widening portions 2261 are formed as wings extended from two sides of the rectangular plate. Here, the overall width between the two first widening portions 2261 may be greater than or equal to the distance between the flat contact portion 225 of the positive signal terminal 2211 of the first pair of signal terminals 221 and the flat contact portion 225 of the negative signal terminal 2212 of the second pair of signal terminals 221. Furthermore, a third distance D3 between the body portion 226 of the positive signal terminal 2211 of the first pair of signal terminals 221 and the body portion 226 of the negative signal terminal 2212 of the second pair of signal terminal 221 may be further increased. Accordingly, crosstalk interferences and radiofrequency interference (RFI) between the body portions 226 of the first pair of signal terminals 221 and the second pair of the signal terminals 221 are reduced.

Please refer to FIG. 2, FIG. 3, and FIG. 6. In this embodiment, the first distance D1 is defined between each of the first widening portions 2261 and the body portion 226 of the corresponding nearest signal terminal 221, and for each pair of the two pairs of signal terminals, a second distance D2 is defined between the two signal terminals 2211, 2212. In this embodiment, the first distance D1 is greater than the second distance D2. Specifically, the first distance D1 may be, but not limited to, in the range from 0.57 mm to 1.17 mm. In some embodiments, the first distance D1 may be, but not limited to, 0.87 mm. In addition, the second distance D2 may be, but not limited to, in the range from 0.2 mm to 0.8 mm. In some embodiments, the second distance D2 may be, but not limited to, 0.5 mm. In some embodiments, the first distance D1 is may be, but not limited to, from 0.57 mm to 1.17 mm, the first distance D1 is less than, equal to, or greater than the second distance D2, and the second distance D2 is defined in the range from 0.2 mm to 0.8 mm.

Furthermore, the position of the first widening portions 2261 corresponds to signal terminals of the flexible terminals 21. Therefore, when the third distance D3 between the body portion 226 of the positive signal terminal 2211 of the first pair of signal terminals 221 and the body portion 226 of the negative signal terminal 2212 of the second pair of signal terminal 221 is increased, the distance between the body portion 226 of each of the signal terminals 221 of the flat terminals 22 and the signal terminals of the flexible terminals 21 (the middle two terminals of the flexible terminals 21 shown in FIG. 3) can be reduced, and the crosstalk interferences between the signal terminals of the flexible terminals 21 (USB 2.0) and the signal terminals 221 of the flat terminals 22 (USB 3.0/USB 3.1) are improved.

Please refer to FIG. 2, FIG. 3, and FIG. 6. Additionally, each of the first widening portions 2261 of the ground terminal 222 comprises a chamfering edge 2262 parallel with the corresponding slant portion 229. That is, each of the first widening portions 2261 has a chamfering structure. Accordingly, the ground terminal 222 and each of the nearest signal terminals 221 of the flat terminals 22 are spaced by the first distance D1 over the whole terminals, and the signal transmission of the two pairs of signal terminals 221 can be performed steadily.

Please refer to FIG. 2, FIG. 3, and FIG. 6. Moreover, each of the flat terminals 22 further comprises a machining portion 228 extended from the rear end of the flat contact portion 225 to the body portion 226. Prior to a machining process, the flat terminals 22 are connected with each other and have a portion to be removed, where the portion is located between the machining portions 228 of the flat terminals 22 to connect the machining portions 228. Next, after the machining process, the portion between the machining portions 228 are removed, so that the flat terminals 22 are not in contact with each other.

Please refer to FIG. 2, FIG. 3, and FIG. 6. Each of the flat terminals 22 further comprises an elevating portion 25 bent from the rear end of the body portion 226 and extended upward, and the elevating portion 25 is extended from the rear end of the body portion 226 to the tail portion 227. The shape of the flat terminals 22 is adapted to the shape of the base portion 111 of the insulated housing 11. That is, the elevating portions 25 and the tail portions 227 are arranged on the base portion 111, and the tail portions 227 exposed out of the base portion 111 are, but not limited to, connected to the circuit board by through-hole technologies. In one embodiment, the tail portions 227 are arranged to be horizontal and connected to the circuit board by SMT (Surface mounted technology) means. Moreover, each of the elevating portions 25 comprises two second widening portions 251 respectively extended outward from two sides thereof. The second widening portions 251 are extended backward from the respective first widening portions 2261, and the width of each of the first widening portions 2261 is greater than the width of each of the second widening portions 251. Accordingly, the crosstalk interference and the radiofrequency interference between the first pair of signal terminals 221 and the second pair of signal terminals 221 can be further reduced.

Figure 7:
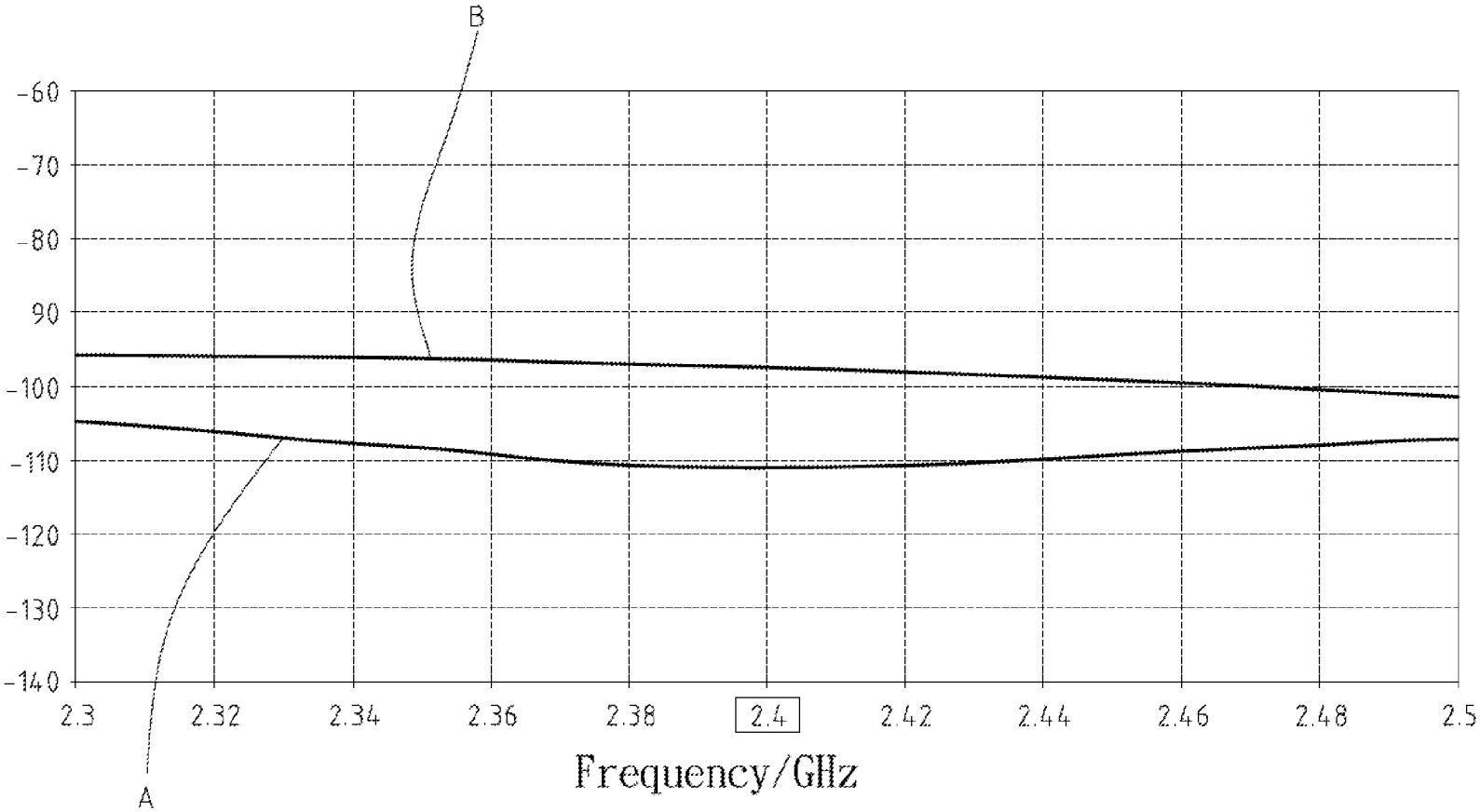
FIG. 7 is a schematic analysis curve (1) of the flat terminals of the electrical receptacle connector according to the instant disclosure.
Figure 8:
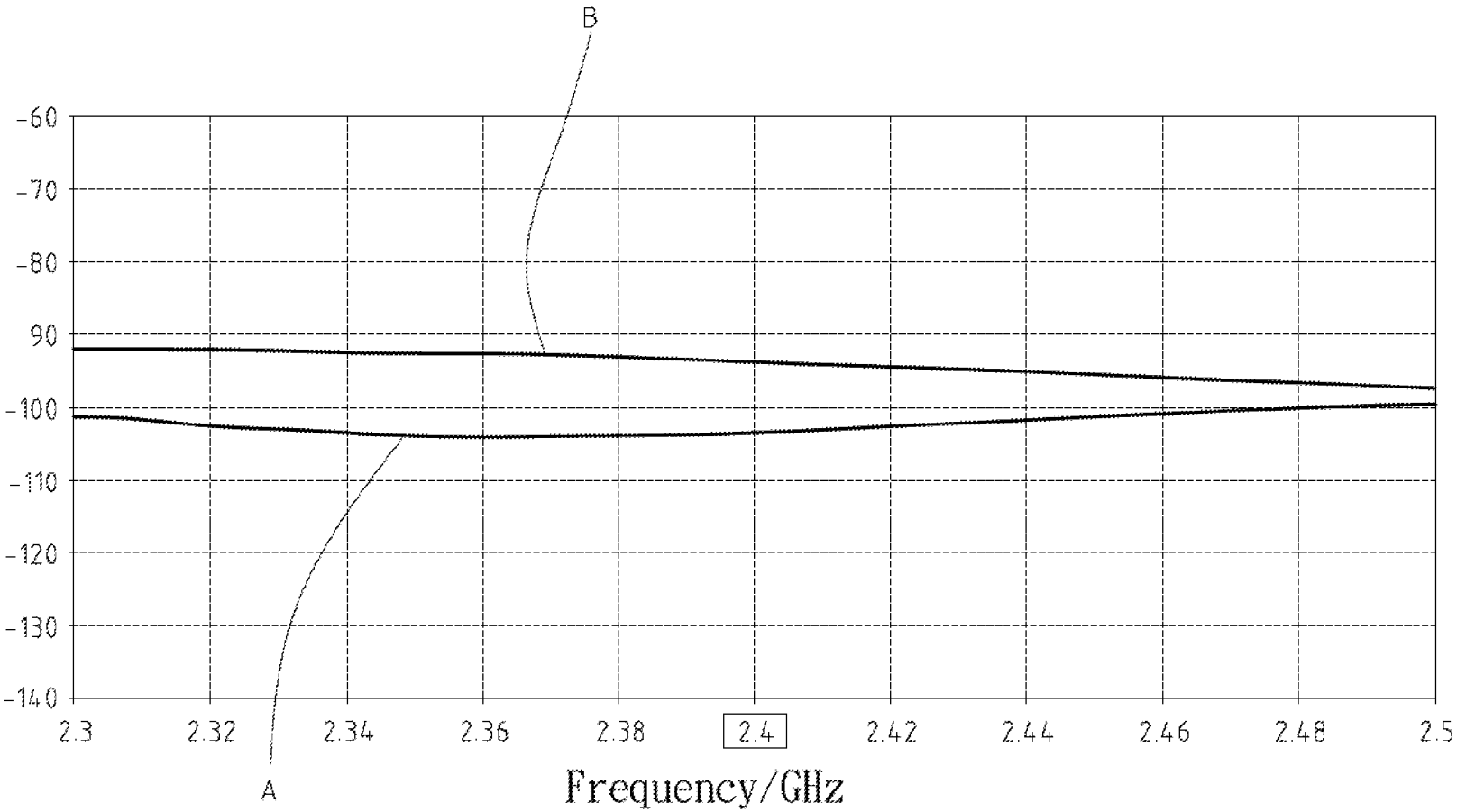
FIG. 8 is a schematic analysis curve (2) of the flat terminals of the electrical receptacle connector according to the instant disclosure.
Figure 9:
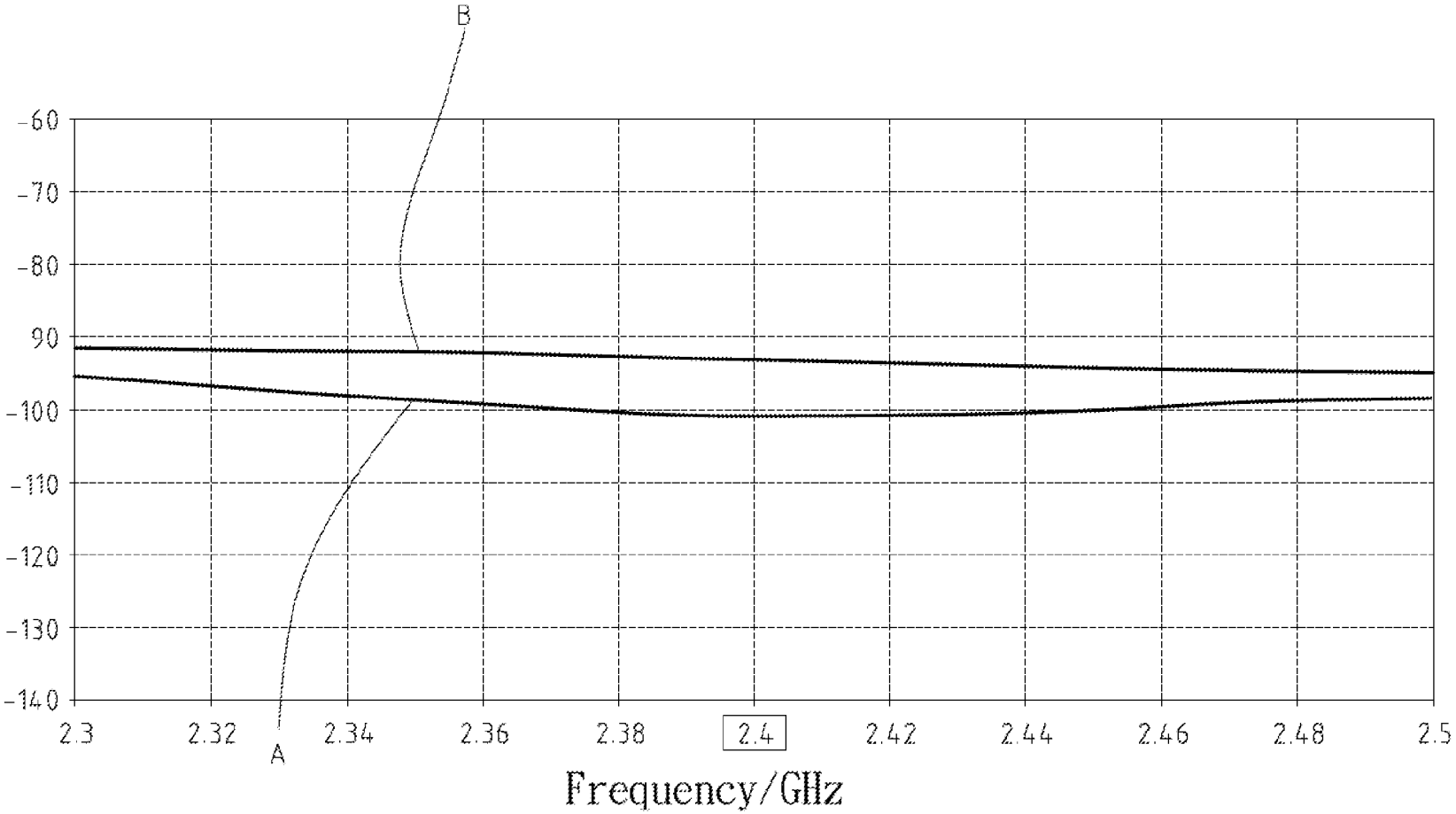
FIG. 9 is a schematic analysis curve (3) of the flat terminals of the electrical receptacle connector according to the instant disclosure.
Figure 10:
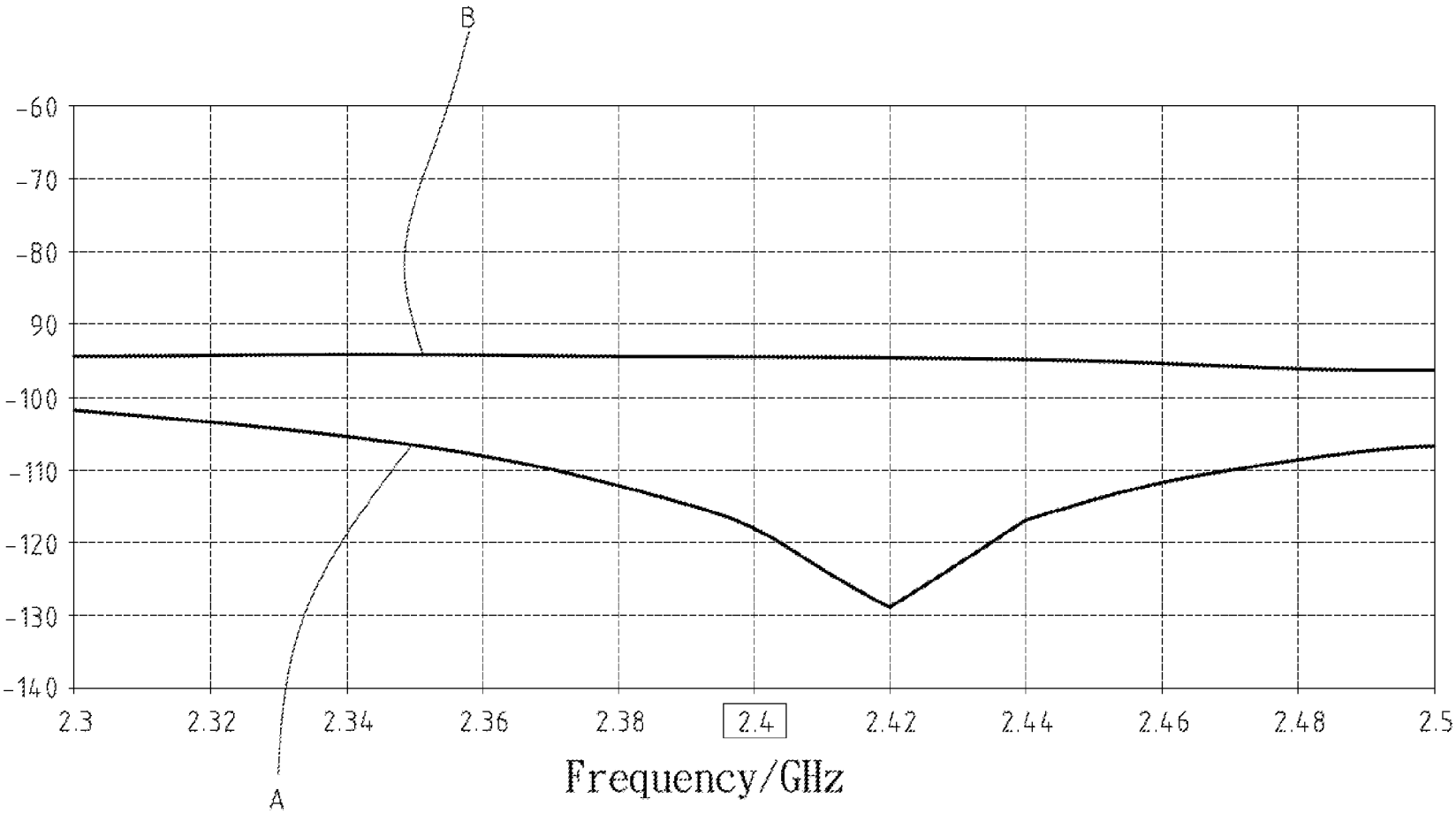
FIG. 10 is a schematic analysis curve (4) of the flat terminals of the electrical receptacle connector according to the instant disclosure.

Please refer to FIG. 7 to FIG. 10, illustrating schematic analysis curves of noises received by a detector where the noises are emitted from different parts of the flat terminals 22. Here, FIG. 7 shows a schematic analysis curve of noises received by a detector which is placed above the flat terminals 22, FIG. 8 shows a schematic analysis curve of the noises received by the detector which is placed at the left side of the flat terminals 22, FIG. 9 shows a schematic analysis curve of the noises received by the detector which is placed underneath the flat terminals 22, and FIG. 10 shows a schematic analysis curve of the noises received by the detector which is placed at the right side of the flat terminals 22. Here, curve A is generated by testing the electrical receptacle connector 100 according to the instant disclosure in which the third distance D3 is increased, as compared to the distance between a positive signal terminal of a first pair of signal terminals and a negative signal terminal of a second pair of signal terminals of a conventional electrical receptacle connector, and curve B is generated by testing the conventional electrical receptacle connector. As shown in FIG. 7 to FIG. 10, curve A is lower than curve B, which means when the third distance D3 of the electrical receptacle connector 100 is increased, noises emitted from the electrical receptacle connector 100 can be reduced. Accordingly, the crosstalk interference and the radiofrequency interference between the first pair of signal terminals 221 and the second pair of signal terminals 221 can be reduced.

Based on the above, the third distance D3 can be adjusted not to be less than a certain value, so crosstalk interferences and radiofrequency interference (RFI) between the body portions of the two pairs of the signal terminals can be reduced. Next, the first distance may be less than, equal to, or greater than the second distance to improve the signal transmission stability, the coupling effect between the signal terminals, to reduce unnecessary energy emissions, and to reduce the crosstalk interferences between the first pair of signal terminals (USB 3.0/USB 3.1) and the second pair of signal terminals (USB 3.0/USB 3.1) during signal transmission. In addition, the second distance may be adjusted to be much smaller, so that the signal coupling between each pair of signal terminals can be further enhanced. Moreover, the distance between the signal terminals of the flat terminals and the signal terminals of the flexible terminals can be reduced, such that the crosstalk interference between the signal terminals of the flexible terminals (USB 2.0) and the signal terminals of the flat terminals (USB 3.0/USB 3.1) can be improved.

While the instant disclosure has been described by the way of example and in terms of the preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. An electrical receptacle connector, comprising:

a metallic shell, defining a receiving cavity therein;

an insulated housing received in the receiving cavity, wherein the insulated housing comprises a base portion and a tongue portion extended from one of two sides of the base portion, wherein the tongue portion has an upper surface and a lower surface, and the upper surface is opposite to the lower surface;

a plurality of flexible terminals, wherein each of the flexible terminals is held in the base portion and the tongue portion and disposed at the upper surface of the tongue portion; and a plurality of flat terminals, wherein each of the flat terminals is held in the base portion and the tongue portion and disposed at the upper surface of the tongue portion, wherein each of the flat terminals is arranged in front of the corresponding flexible terminal, wherein the flat terminals comprise two pairs of signal terminals and a ground terminal between the two pairs of signal terminals, wherein each of the flat terminals comprises a flat contact portion arranged at the tongue portion, a tail portion extended from the rear end of the flat contact portion, and a body portion between the flat contact portion and the tail portion, wherein the body portion of the ground terminal comprises two first widening portions respectively extended outwardly from two sides thereof, wherein a first distance is the distance between each of the first widening portions and the body portion of the corresponding nearest signal terminal, a second distance is the distance between the two signal terminals for each pair of the signal terminals, and the body portion of each of the signal terminals is protruding away from a corresponding lateral side of the first widening portion.

2. The electrical receptacle connector according to claim 1, wherein the first distance is greater than, less than, or equal to the second distance.

3. The electrical receptacle connector according to claim 1, wherein the insulated housing further comprises a plurality of positioning slots defined longitudinally on the upper surface of the tongue portion and extended to the base portion for receiving the respective flexible terminals.

4. The electrical receptacle connector according to claim 1, wherein the flat terminals are conformed to the specification of a USB 3.0 or a USB 3.1 connection interfaces, and the flexible terminals are conformed to the specification of a USB 2.0 connection interface.

5. The electrical receptacle connector according to claim 1, wherein each of the flat terminals further comprises an elevating portion bent from the rear end of the body portion and extended upward, and wherein the elevating portion is extended from the rear end of the body portion to the tail portion.

6. The electrical receptacle connector according to claim 5, wherein each of the elevating portions comprises two second widening portions respectively extended outward from two sides thereof.

7. The electrical receptacle connector according to claim 1, wherein each of the flat terminals further comprises a machining portion extended from the rear end of the flat contact portion to the body portion.

8. The electrical receptacle connector according to claim 7, wherein each of the flat terminals further comprises a slant portion extended from the rear end of the machining portion to the body portion, wherein each of the first widening portions of the ground terminal comprises a protruding portion, and the edge of the protruding portion is parallel with the slant portion.

9. The electrical receptacle connector according to claim 1, wherein each pair of signal terminals comprises a positive signal terminal and a negative signal terminal, wherein the positive signal terminal of the first pair of signal terminals is between the negative signal terminal of the first pair of signal terminals and the ground terminal, and wherein the negative signal terminal of the second pair of signal terminals is between the positive signal terminal of the second pair of signal terminals and the ground terminal.

10. The electrical receptacle connector according to claim 9, wherein the flat contact portion and the body portion of the positive signal terminal of the first pair of signal terminals are arranged at different horizontal lines, and wherein the flat contact portion and the body portion of the negative signal terminal of the second pair of signal terminals are arranged at different horizontal lines.

* * * * *